US006082003A

United States Patent [19]

Douven et al.

[11] Patent Number: 6,082,003

[45] **Date of Patent: *Jul. 4, 2000**

[54] SHAVING APPARATUS

[75] Inventors: Lucien F. A. Douven, Eindhoven; Simon E. Kadijk, Drachten; Hendrik Poel, Glimmen, all of Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/023,602

[22] Filed: Feb. 13, 1998

[30] Foreign Application Priority Data

Feb. 19, 1997 [EP] European Pat. Off. ..... 97301059

[51] Int. Cl.[7] ..... B26B 19/14

[52] U.S. Cl. ..... 30/43.6; 30/346.51

[58] Field of Search ..... 30/43.4, 43.5, 30/43.6, 346.51

[56] References Cited

U.S. PATENT DOCUMENTS

| | | | |
|---|---|---|---|
| 3,639,979 | 2/1972 | Zuurveen | 30/43.6 |
| 4,001,932 | 1/1977 | Herrick | 30/43.5 |
| 4,663,842 | 5/1987 | Bosch | 30/43.6 |
| 4,711,028 | 12/1987 | Bergsma et al. | 30/43.6 |
| 5,329,702 | 7/1994 | Uchiyama et al. | 30/346.41 |

FOREIGN PATENT DOCUMENTS

| | | | |
|---|---|---|---|
| 0231966 | 10/1990 | European Pat. Off. | B26B 19/14 |

OTHER PUBLICATIONS

PCT/IB98/00114, Search Report Dated Jun. 4, 1998.

*Primary Examiner*—Hwei-Siu Payer
*Attorney, Agent, or Firm*—Ernestine C. Bartlett

[57] ABSTRACT

A shaving apparatus has a head assembly (2) which houses rotary cutters (8), and guards (4) which are provided with an annular series of hair-entry apertures (6). A fixed supporting surface is provided inside and outside the ring of apertures, to provide support when shaving with large applied pressure.

5 Claims, 3 Drawing Sheets

SHAVING APPARATUS

BACKGROUND OF THE INVENTION

This invention relates to a shaving apparatus of the type having a shaving head with at least one rotary cutting assembly which comprises a rotary cutter housed within a guard.

In a conventional shaving apparatus of the type described above, the rotary cutter is housed within a substantially cylindrical guard having a closed end face for contact with the skin. Hair-entry apertures are provided around the outer edge of this face, and the blades of the rotary cutter rotate within the guard adjacent these apertures. The cutter assembly has a spring mounting within the shaving head, so that the guard projects beyond a peripheral face of the shaving head.

When pressure is applied to the shaving head against the operator's face during use, the cutter assemblies may retract until they reach a stop, and any further pressure increase is distributed over the guards and the peripheral face of the shaving head. An assembly of this type is described in EP-0-231 966, which corresponds substantially to U.S. Pat. No. 4,711,028.

SUMMARY OF THE INVENTION

It is an object of the invention to improve the shaving characteristics of a rotary head shaving apparatus over the wide range of forces which may be applied to the shaver during use.

According to the invention, there is provided a shaving apparatus comprising a head assembly which houses at least one cutter assembly, the cutter assembly comprising a rotary cutter having cutter blades housed within a guard, the guard being provided with hair-entry apertures arranged in an annular ring, wherein a peripheral surface of the head assembly comprises, for the or each cutter assembly, a first portion inside the annular ring and a second portion outside the annular ring, the first and second portions being fixed with respect to each other (when the shaving apparatus is assembled, if supplied as a kit of parts).

In the shaving apparatus of the invention, the area within the ring of hair-entry apertures comprises a fixed surface which defines part of the force-absorbing peripheral surface of the head assembly. Thus, an increased force absorbing surface is provided which is found to improve the shaving characteristics over a wide range of applied forces, as will be explained in the following description.

Preferably, the rotary cutter and the first portion of the peripheral surface are fixed to the body of the shaving apparatus, and the guard is fixed to a removable cover portion of the housing. In this way, the removal of the cover portion simultaneously exposes the guard and the rotary cutter or cutters for subsequent cleaning. Preferably, a cut-off switch is provided so that the rotary cutters may not be operated when the removable cover has been removed.

The guard is preferably slidably received within the removable cover, and the rotary cutter is resiliently biased towards the guard. The shaving apparatus preferably comprises two or three cutter assemblies.

BRIEF DESCRIPTION OF THE DRAWINGS

The invention will now be described by way of example, with reference to the accompanying drawings, in which.

DESCRIPTION OF THE PREFERRED EMBODIMENTS

Figure 1:
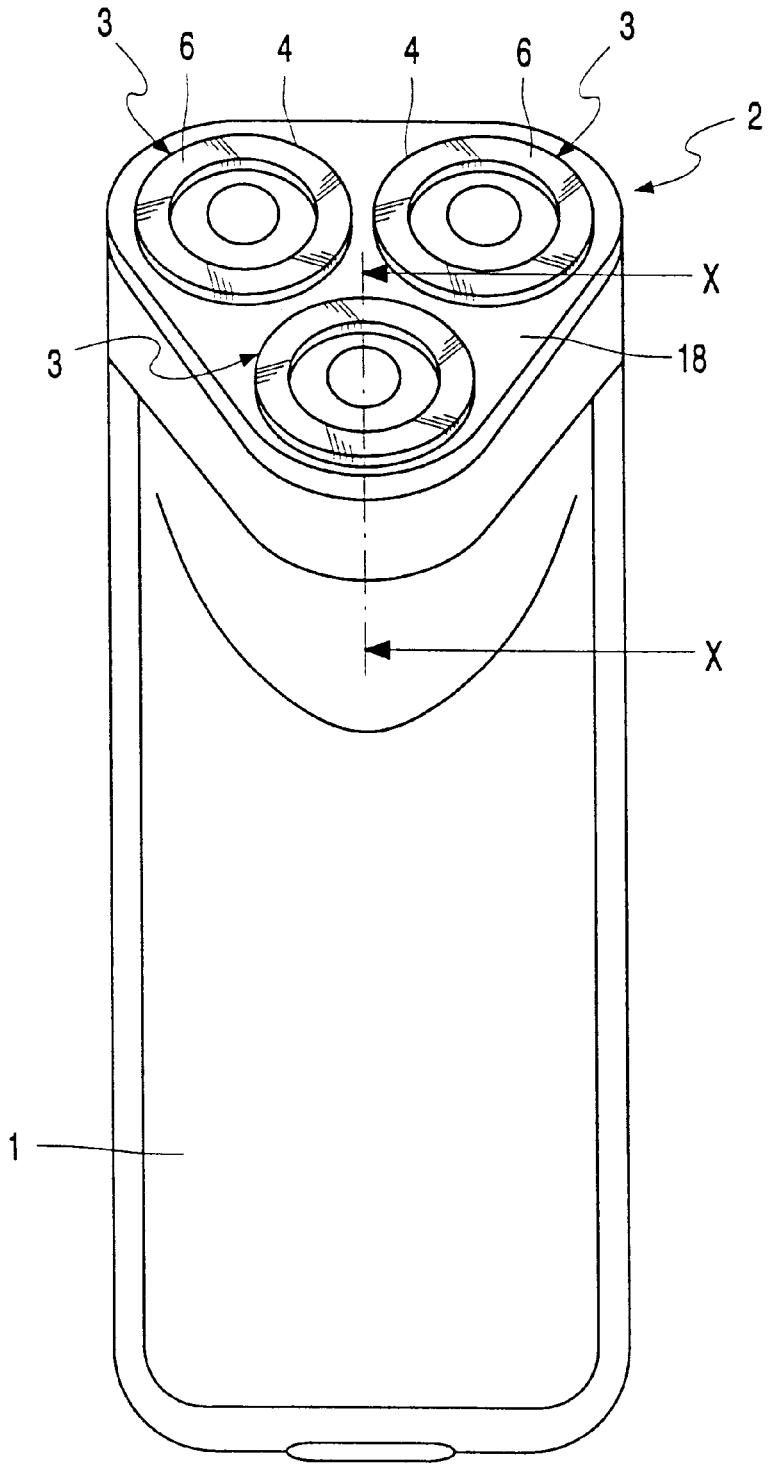
FIG. 1 is a front view of a shaving apparatus to which the invention may be applied.

The shaving apparatus shown in FIG. 1 comprises a body 1 and a shaving head 2, the head 2 housing three cutter assemblies 3. Each cutter assembly 3 comprises an external guard 4 provided with hair-entry apertures 6 arranged in an annular ring, and an internal rotary cutter 8 (shown in FIGS. 2 and 3) which is rotatable relative to the guard 4. The rotary cutters 8 are driven by means of an electric motor which is accommodated in the body 1 of the shaving apparatus.

The features described so far are present in both a conventional rotary shaving apparatus and in the shaving apparatus of the invention.

Figure 2:
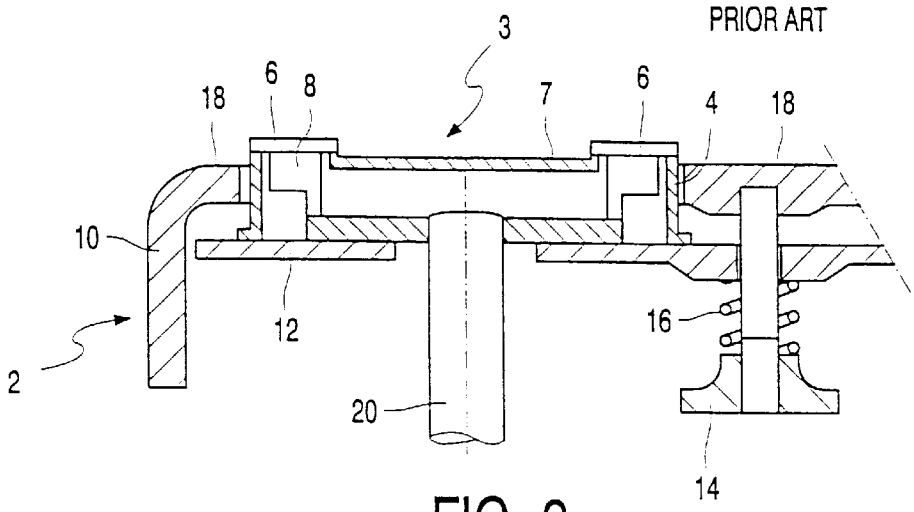
FIG. 2 is a sectional view along the line X—X in FIG. 1 to show in greater detail one example of a conventional rotary shaving head.

FIG. 2 shows in greater detail one example of a conventional cutter assembly 3. The shaving head 2 comprises a shaving head housing 10 having apertures for receiving the cutter assemblies 3. Each cutter assembly 3, comprising the guard 4 and the rotary cutter 8, is retained in the shaving head 2 by a retaining plate 12 which releasably engages the housing 10. The guard 4 is detachably secured to the retaining plate 12, and the retaining plate 12 is secured to the housing 10 by a fixing screw 14. A resilient element in the form of a helical spring 16 is compressed between the retaining plate 12 and the head of the fixing screw 14, which enables the retaining plate 12 to move to a limited extent relatively to the housing 10. As a result, the guard 4 is moveable relatively to the housing 10 substantially perpendicularly to the peripheral face 18 of the housing 10. The fixing of the retaining plate 12 within the housing 10 is arranged such that the closed end face of each guard 4 projects beyond the peripheral face 18 of the housing 10.

The rotary cutters 8 are each engaged by an associated drive shaft 20 which centers the respective rotary cutter 8. The shaft itself is retractable along the direction of its axis, to enable the retraction of cutter assembly while it is being driven. The guard 4 has hair-entry apertures 6 disposed in a ring at the outer edge of the end face of guard 4, and has a sunk portion 7, within the ring defined by the hair-entry apertures 6.

Figure 3:
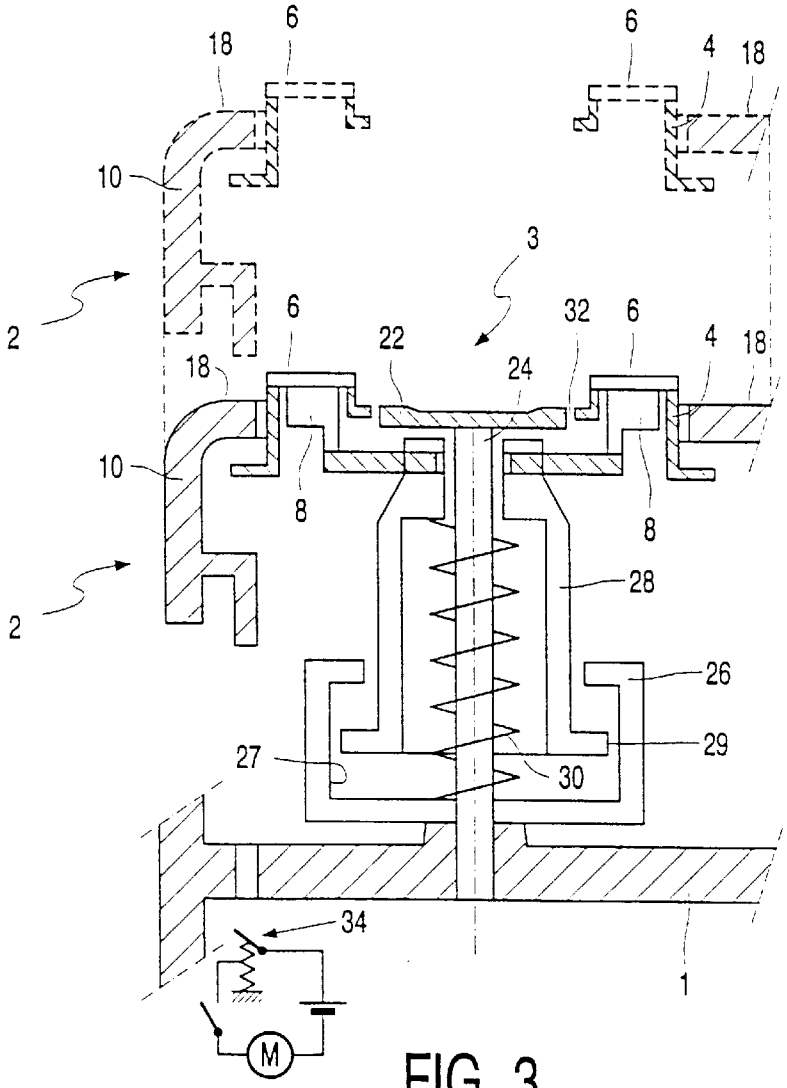
FIG. 3 is a sectional view taken on the line X—X in FIG. 1 to show in greater detail a rotary shaving head of the invention.

The cutter assembly 3 of the invention is shown in detail in FIG. 3, in which the same reference numerals have been used as in FIG. 2 for similar components. The guard 4 used in the cutter assembly 3 of the invention again has an annular series of hair-entry apertures 6, but the guard 4 has a central opening 32 within the ring defined by the apertures 6. A fixed supporting disc 22 is provided in this central opening 32, and may be considered to define a portion of the peripheral face 18 of the shaving head. Thus, a first portion of the peripheral face 18 of the head 2 is defined by the disc 22, and a second portion is defined by the housing 10.

The supporting disc 22 may have a raised portion around its circumference, which may be arranged to be level with the second portion of the face 18 outside the ring of hair-entry apertures 6. Thus, the outer edge of the disc 22 provides a skin-contact surface.

The disc 22 is fixed to the body 1 of the shaving apparatus through a spindle 24, which also acts as a central support for the drive mechanism of the rotary cutter 8. This drive mechanism comprises a gear wheel 26 which is coupled to the drive motor of the shaving apparatus by a mechanism which is not shown in the drawings. The gear wheel 26 has a series of internal teeth 27 which engage external teeth 29 on a coupling member 28 which transmits rotational torque from the gear wheel 26 to the rotary cutter 8. The engagement between the coupling member 28 and the gear wheel 26 enables limited movement of the coupling member 28 along the axis of the spindle 24, and the coupling member 28 is biased towards the peripheral face 18 by a spring 30.

The rotary cutter 8 is coupled to the end of the coupling member 28 by any appropriate bearing, which should enable some movement of the rotary cutter 8 in a plane perpendicular to the axis of the spindle 24. The rotary cutter 8 is centered through the engagement of the cutter blades in the channel defined by the annular guard 4.

The improved shaving response of the shaving apparatus of the invention will now be described. The overall pressing force applied to a shaving apparatus in use is distributed over the cutter assemblies and over the peripheral surface of the shaving head. In a conventional shaving head, a raised rim may surround each cutter assembly which acts as a skin-tautening rim, and this rim also acts as a force-absorbing surface. The force on the skin at the location of the hair-entry apertures determines the level of bulging of the skin into the hair-entry apertures. This is an important parameter to control, since some skin bulging is desirable for a close shave, whereas excessive bulging will result in discomfort or irritation to the skin. Preferably, the level of bulging should be independent of variations in the pressing force applied by the user (hereinafter referred to as "shaving force").

Figure 4:
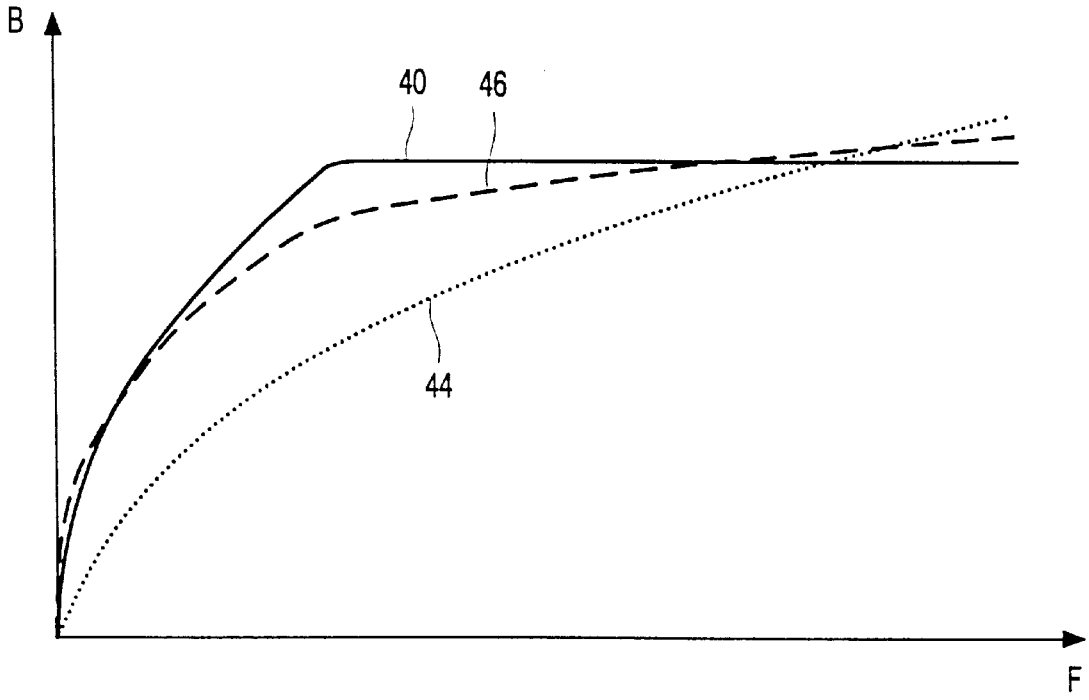
FIG. 4 is a graph representing shaving characteristics over a range of applied pressures.

In FIG. 4, curve 40 shows the ideal bulging B of the skin as a function of the shaving force F applied to the shaving apparatus, and which should be approximated to by a practical apparatus. For low shaving forces, the degree of bulging should increase rapidly, after which it should remain as constant as possible for higher shaving forces. To approximate to this curve, the cutter assemblies (of both FIGS. 2 and 3) are arranged to absorb all of the shaving force in the case of low shaving forces, and the shaving head housing absorbs a proportion of the shaving force in the case of high shaving forces, when the cutter assemblies have retracted.

This optimum response can not be achieved totally in practice. For example, a conventional shaving apparatus, such as shown in FIG. 2, has the response shown by curve 44. The suspension of the cutter assemblies within the shaving head does ensure that only the cutter assemblies are in contact with the skin for low shaving forces, and this gives rise to the relatively rapid initial rise in bulging. However, the central portion of each cutter assembly absorbs some of the shaving force even for low shaving forces, which limits the initial rise in bulging. For higher overall shaving forces, the fixed peripheral surface of the housing then absorbs a further proportion of the force increase, in such a manner that the bulging increases less rapidly. However, the flat ideal response of curve 40 cannot be approached, particularly because of the small area of the skin-tautening rims in the conventional apparatus.

The apparatus according to the invention has the response shown as curve 46 which approximates much more closely to the desired ideal response. For low shaving forces, the annular ring of hair entry apertures absorbs the total shaving force, so that the bulging rises rapidly to the selected optimal value for shaving. For higher shaving forces, the provision of a force absorbing surface within the rim of hair-entry apertures provides a greater surface for distributing the additional shaving force, and provides support for the skin both inside and outside the ring of apertures. Consequently, the additional applied shaving force is distributed over the fixed peripheral face (face 18 and disc 22), and the pressing force on the annular ring of hair entry apertures remains substantially constant.

The shaving apparatus of the invention, as shown in FIG. 3, also simplifies the cleaning operation of the shaving head assembly. In particular, the rotary cutter 8 and the coupling member 28 are secured to the body 1 of the shaving apparatus and thereby remain in place when the head 2 is removed. The guard 4 is secured to the head 2 to allow limited movement of the guard with respect to the head 2 by a suitable coupling (not shown in the drawings). Thus, removal of the head 2 exposes the rotary cutter 8 which remains connected to the body 1 of the shaving apparatus, and also exposes the hair-entry apertures 6 which are coupled to the removed head 2. The supporting disc 22 remains secured to the body 1 of the shaving apparatus. A cut-off switch 34 is required to ensure that the rotary cutter 8 cannot be operated when the head assembly 2 has been removed, and an appropriate form of cutoff switch will be apparent to those skilled in the art.

The cutter assemblies in the shaving apparatus of the invention are independently sprung, and the suspension of the cutter assemblies will be designed to achieve the best shaving characteristics, by appropriate selection of the spring stiffness and pre-tension. For example, the ring of hair-entry apertures may have an inner diameter of 14 mm and an outer diameter of 20 mm. For this size of cutter assembly, a spring pre-tension of approximately 0.5N is appropriate, so that for shaving forces of less than 0.5N, the entire shaving force is absorbed by the ring of hair-entry apertures. A shaving force of approximately 0.5N is required to obtain the ideal level of bulging into the hair-entry apertures. A low spring stiffness is desired so that the cutter assembly retracts quickly once the ideal level of bulging has been obtained. Consequently, the peripheral face of the shaving head housing absorbs any further increase in the shaving force, and the force on the ring of hair-entry apertures remains substantially constant. For example, a spring stiffness of 0.1 to 0.2 N/mm is appropriate.

Manipulation of the spring characteristics will influence the response of FIG. 4. Furthermore, the design of the inner supporting disc 22 also influences the shaving response. For example, the amount of projection of the guard 4 beyond the face 18 may be different from the projection of the guard beyond the disc 22. Typically, the projection of the ring of hair-entry apertures 6 when the guard is fully extended is 0.5 to 1.0 mm. The supporting disc 22 may project slightly beyond the face 18, for example with the ring of hair-entry apertures 6 of the guard 4 projecting 0.9 mm beyond the face 18 and 0.7 mm beyond the rim of the supporting disc 22.

The shape of the central supporting disc may also influence the response of FIG. 4, and may be designed to optimize the skin-tautening effect of the disc during shaving.

What is claimed is:

1. A shaving apparatus comprising a head assembly which houses at least one cutter assembly, the cutter assembly comprising a rotary cutter having cutter blades housed within a guard, the guard being provided with hair-entry apertures arranged in an annular ring and having a central opening within said annular ring, wherein the peripheral surface of the head assembly comprises, for the or each cutter assembly, a first portion inside the opening of said annular ring and a second portion outside the annular ring, the first and second portions being fixed with respect to each other, wherein a portion of the head assembly is removable, and, for the or each cutter assembly, the rotary cutter and the first portion of the peripheral surface are fixed to a shaver body portion, and the guard is secured to the removable portion of the head assembly.

2. A shaving apparatus as claimed in claim 1, wherein a cut-off switch is provided to prevent the operation of the shaving apparatus when the portion of the head assembly is removed.

3. A shaving apparatus comprising a head assembly which houses at least one cutter assembly, the cutter assembly comprising a rotary cutter having cutter blades housed within a guard, the guard being provided with hair-entry apertures arranged in an annular ring and having a central opening within said annular ring, wherein the peripheral surface of the head assembly comprises, for the or each cutter assembly, a first portion inside the opening within said annular ring and a second portion outside the annular ring, the first and second portions being fixed, said first portion being fixed to a body portion of the shaving apparatus.

4. A shaving apparatus as claimed in claim 1, wherein the rotary cutter is resiliently biased against the guard, and the cutter assembly is retractable with respect to the head assembly against the resilient bias.

5. A shaving apparatus comprising a head assembly which houses at least one cutter assembly, the cutter assembly comprising a rotary cutter having cutter blades housed within a guard, the guard being provided with hair-entry apertures arranged in an annular ring, wherein the peripheral surface of the head assembly comprises, for the or each cutter assembly, a first portion inside the annular ring and a second portion outside the annular ring, the first portion of the peripheral surface being fixed to a body portion of the shaving apparatus, and the guard being secured to a removable portion of the head assembly.

* * * * *